US005117565A

United States Patent [19]

Willenbacher, Jr.

[11] Patent Number: 5,117,565

[45] Date of Patent: Jun. 2, 1992

[54] GLOVE DRYING APPARATUS

[76] Inventor: Thomas H. Willenbacher, Jr., Box 716, E. Worcester, N.Y. 12064

[21] Appl. No.: 740,717

[22] Filed: Aug. 6, 1991

[51] Int. Cl.[5] ..... F26B 25/00

[52] U.S. Cl. ..... 34/103; 34/104; 223/78

[58] Field of Search ..... 34/103, 104, 106, 21, 34/151, 239, 240; 223/78, 79, 80, 52

[56] References Cited

U.S. PATENT DOCUMENTS

| | | | |
|---|---|---|---|
| 1,688,793 | 10/1928 | Schrenkeisen | 34/104 |
| 1,736,679 | 11/1929 | Tierney | 223/78 |
| 2,035,094 | 3/1936 | Palicki | 223/78 |
| 2,091,942 | 8/1937 | Gemeiner | 223/78 |
| 2,783,925 | 3/1957 | Ross | 223/78 |
| 3,096,008 | 7/1963 | Schumacher | 223/78 |
| 3,409,142 | 11/1968 | Mechaneck | 223/78 |
| 4,209,913 | 7/1980 | Wallin et al. | 223/79 |
| 5,011,053 | 4/1991 | Davies | 34/104 |

*Primary Examiner*—Henry A. Bennet
*Assistant Examiner*—Denise Gromada
*Attorney, Agent, or Firm*—Leon Gilden

[57] ABSTRACT

A glove drying frame configured as a human hand is formed of a wire mesh hollow body to accommodate a glove thereon, with the hollow body mounting a support clip to a wrist portion of the hollow body to permit suspension of the hollow body permitting free-flow of drying air to be directed interiorly of the hollow body. The invention further includes a mounting framework for support of a plurality of hollow bodies permitting directing of a drying medium within the hollow bodies.

2 Claims, 4 Drawing Sheets 16
15
31
11
12
13
14

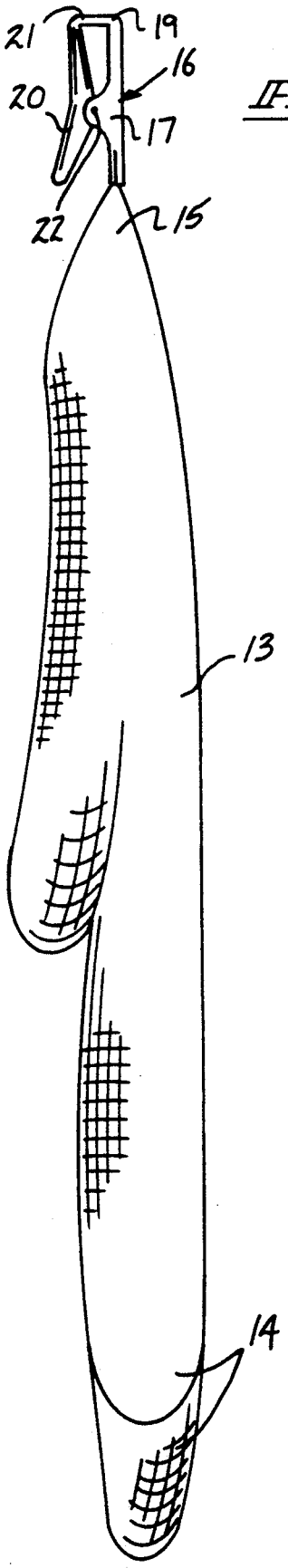
Fig 2
Fig 3
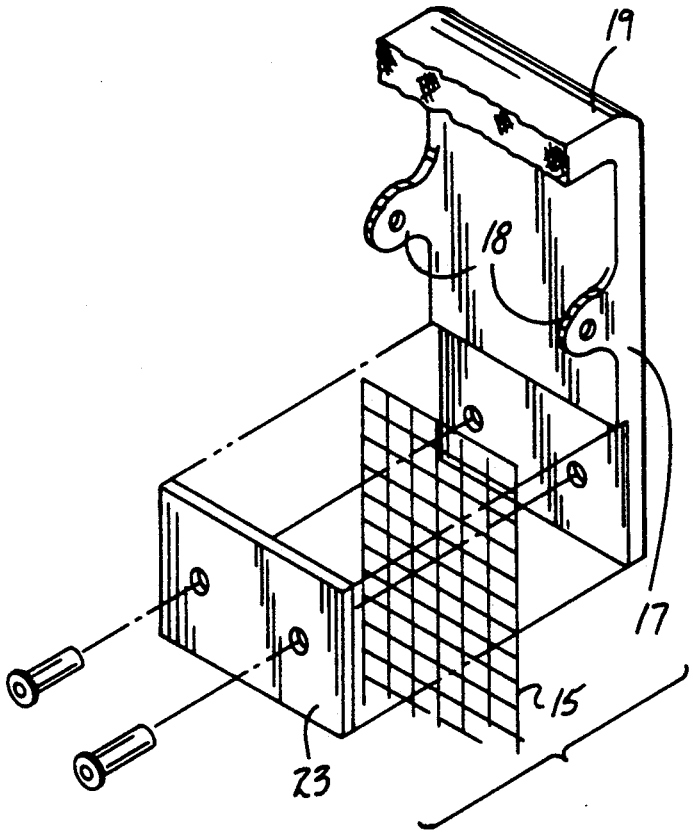

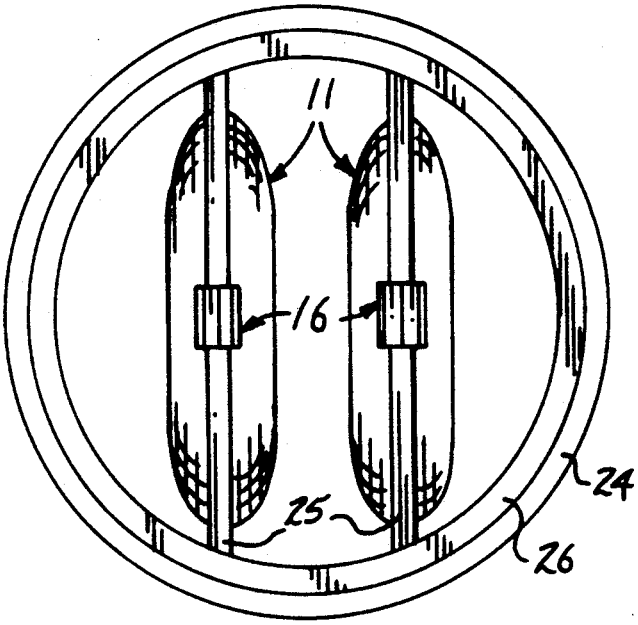
FIG 4
FIG 5
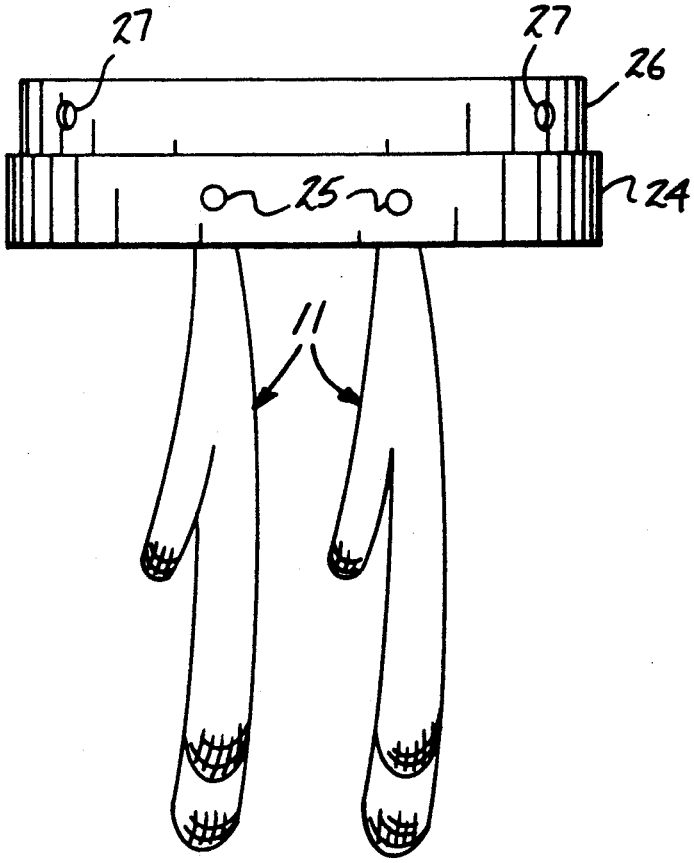

GLOVE DRYING APPARATUS

BACKGROUND OF THE INVENTION

1. Field of the Invention

The field of invention relates to drying apparatus, and more particularly pertains to a new and improved glove drying apparatus wherein the same is arranged for the complementary mounting of a glove in an opened configuration to permit directing of drying air within the glove.

2. Description of the Prior Art

Drying apparatus of various types are utilized in the prior art to permit the drying of articles such as items formed of non-porous materials. Such structure is exemplified in U.S. Pat. No. 4,209,913 to Wallin, et al. wherein structure for drying a glove includes a resilient drying member that may be temporarily deformed inwardly to allow the glove to be removed and mounted thereon.

U.S. Pat. No. 3,798,788 to Kuntz sets forth a boot and glove drying apparatus, wherein a plurality of support racks are provided to receive a boot or glove thereon in an opened configuration.

U.S. Pat. No. 4,084,733 to Perlmutter sets forth a glove form formed of a ribbed member arranged to be projected within a glove to maintain its opening.

U.S. Pat. No. 3,477,622 to Appelt sets forth a glove drying structure, wherein the generally planar framework is formed to interlocking members to permit support of a glove on each member.

As such, it may be appreciated that there continues to be a need for a new and improved glove drying apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of glove drying apparatus now present in the prior art, the present invention provides a glove drying apparatus wherein the same is arranged for the mounting and orientation of a glove to receive drying air directed therein. As such, the general purpose of the present invention, which will be described subsequently in greater detail, is to provide a new and improved glove drying apparatus which has all the advantages of the prior art glove drying apparatus and none of the disadvantages.

To attain this, the present invention provides a glove drying frame configured as a human hand formed of a wire mesh hollow body to accommodate a glove thereon, with the hollow body mounting a support clip to a wrist portion of the hollow body to permit suspension of the hollow body permitting free-flow of drying air to be directed interiorly of the hollow body. The invention further includes a mounting framework for support of a plurality of hollow bodies permitting directing of a drying medium within the hollow bodies.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved glove drying apparatus which has all the advantages of the prior art glove drying apparatus and none of the disadvantages.

It is another object of the present invention to provide a new and improved glove drying apparatus which may be easily and efficiently manufactured and marketed.

It is a further object of the present invention to provide a new and improved glove drying apparatus which is of a durable and reliable construction.

An even further object of the present invention is to provide a new and improved glove drying apparatus which is susceptible of a low cost of manufacture with regard to both materials and labor, and which accordingly is then susceptible of low prices of sale to the consuming public, thereby making such glove drying apparatus economically available to the buying public.

Still yet another object of the present invention is to provide a new and improved glove drying apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic side view of the instant invention, as set forth in FIG. 1.

FIG. 3 is a partial isometric illustration of the glove drying clip utilized by the invention.

FIG. 4 is orthographic top view of a support ring utilized by the invention.

FIG. 5 is an orthographic side view of the support ring, as illustrated in FIG. 4.

DESCRIPTION OF THE PREFERRED EMBODIMENT

Figure 1:
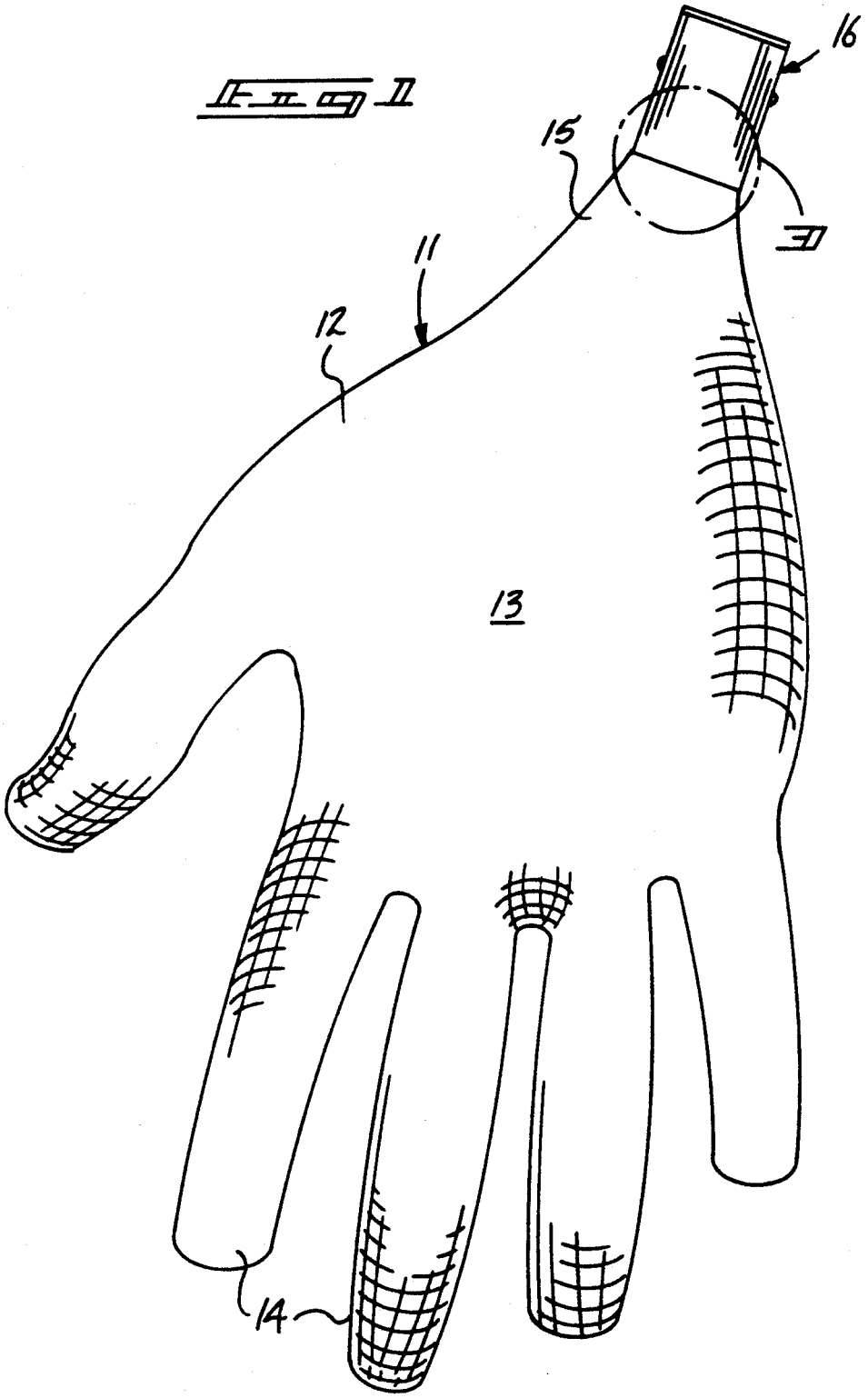
FIG. 1 is an isometric illustration of a glove drying frame utilized by the instant invention.

With reference now to the drawings, and in particular to FIGS. 1 to 8 thereof, a new and improved glove drying apparatus embodying the principles and concepts of the present invention and generally designated by the reference numeral 10 will be described.

More specifically, the glove drying apparatus 10 of the instant invention essentially comprises a drying frame 11 configured as a human hand formed with a wire mesh hollow body 12, including a central body portion 13, with finger projections 14 directed downwardly from the central body portion. A wrist portion 15 defines an upper terminal end of the central body portion 13 mounting support clips 16 thereon. It should be noted that the drying frame 11 is formed of a deformable memory retentent material to permit projection of the drying frame within the associated glove for drying permitting ease of insertion and removal of the drying frame relative to such a glove member.

Support clips 16, as illustrated in FIGS. 2 and 3, illustrate the use of a first clip body plate 17, including a plurality of pivot ears 18 positioned on opposed sides of the body plate medially thereof, with a first jaw 19 integrally formed at an upper terminal end of the first body plate. A second clip body plate 20 is pivotally mounted to the pivot ears 18 about a spring hinge 22 and includes a second jaw 21 mounted at an upper terminal end of the second clip body plate 20 cooperative with the first jaw 19 for securement of the clip 16 to a suitable support.

Figure 6:
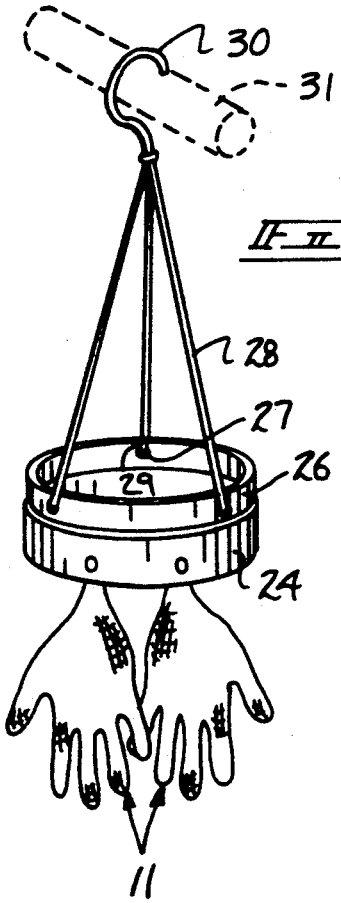
FIG. 6 is an isometric illustration of the glove drying ring mounted to an associated support.
Figure 7:
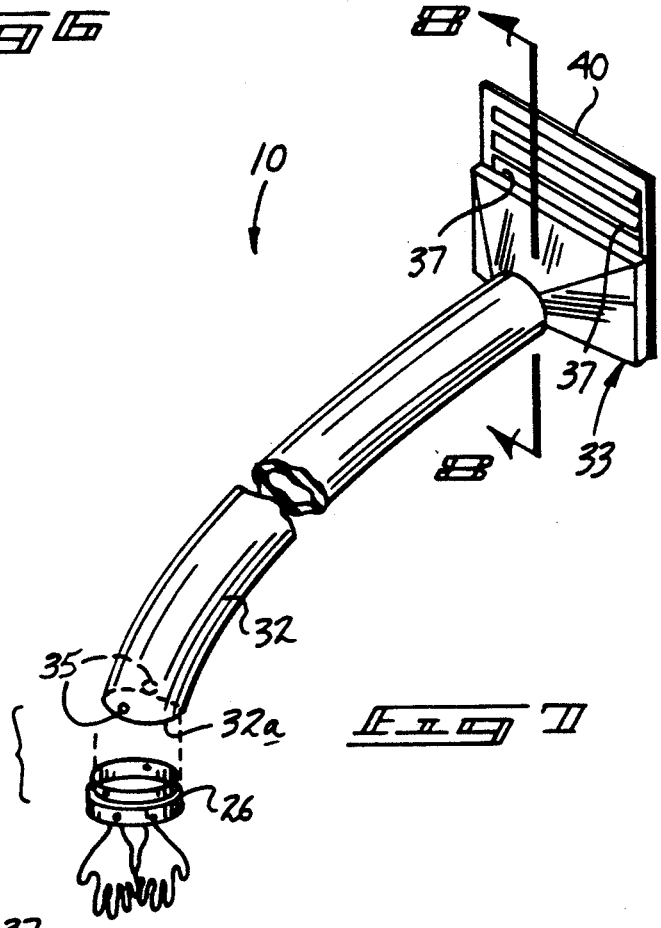
FIG. 7 is an isometric illustration of the use of a drying conduit in association with the invention.
Figure 8:
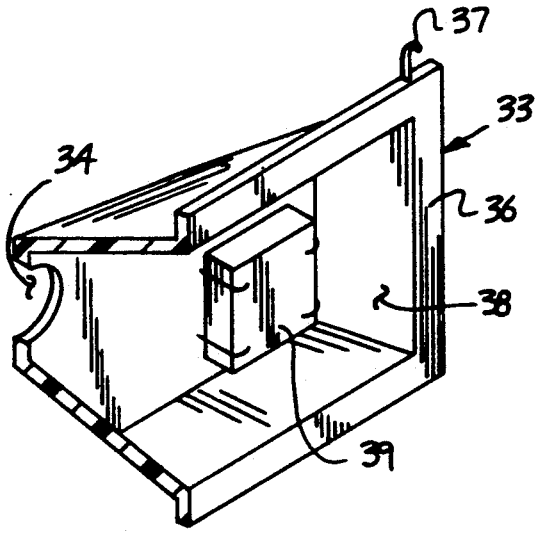
FIG. 8 is an isometric illustration of the directional funnel housing utilized by the invention, taken along the lines 8—8 of FIG. 7 in the direction indicated by the arrows.

FIG. 4 illustrates the use in the invention of a torroidal support ring 24, including a plurality of support rods 25 mounted within the support ring 24. A mounting conduit 26 is integrally and coaxially formed to an upper terminal end of the support ring 24, with the mounting conduit 26 coaxially aligned with the support ring 24. A plurality of mounting conduit bores 27 are positioned through the mounting conduit 26 to receive the leg hooks 29 of a support hanger 28. The support hanger 28 includes a hanger support hook 30 for permitting support of the support ring structure to an associated support rod 31, as illustrated in FIG. 6 for example.

An air conduit 32 of flexible construction includes an air conduit lower terminal end 32*a* formed with a plurality of air conduit bores 35 that are aligned with the mounting conduit bores 27 when the air conduit lower terminal end 32*a* is positioned in surrounding relationship relative to the mounting conduit 26. Further, the alignment of the bores permit the leg hooks 29 to interlock the air conduit 32 to the mounting conduit 26. A directional funnel housing 33 is secured to an upper terminal end of the air conduit 32 formed with an air outlet conduit 34 in pneumatic communication with the air conduit 32. The forward face of the frontal housing 33 includes a housing forward flange 36, including a plurality of flange hooks 37 permitting securement of the funnel housing 33 to an associated air duct 40, as illustrated. Alternatively, the funnel housing 33 may be mounted to a source of convenient pressurized air as available.

The funnel housing 33 includes a housing chamber 38 defined within the housing, with a deodorizer block 39 removably mounted within the housing chamber 38 to direct a deodorant fragrance into each drying frame 11 during a drying procedure.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A glove drying apparatus, comprising, at least one drying frame, the drying frame including a wire mesh hollow deformable body formed of memory retentent material configured as a human hand, including a central body portion, with finger projections extending downwardly from the central body portion, and a wrist portion configured as an upper terminal end of the central body portion, and a support clip mounted to the wrist portion, and the support includes a first body plate with a first body plate lower terminal end, the first body plate, lower terminal end including a clamp plate mounted to the first body plate to secure the wrist portion to a support clip, and the first clip body plate including a second clip body plate pivotally mounted thereto with a spring hinge to bias the first body plate to the second body plate, and the first body plate including a first jaw and the second body plate including a second jaw, wherein the first and second jaws are biased together for mounting of the support clip.

2. An apparatus as set forth in claim 1 including a support ring, the support ring including at least one support rod directed therethrough, the support rod arranged and configured for mounting the support clip thereto, and the support ring including a mounting conduit fixedly mounted to an upper directional funnel housing includes a housing forward flange, the housing forward flange including a plurality of hook members mounted to the housing forward flange for supporting the directional funnel housing to an air duct, and the direction funnel housing further including a housing chamber, the housing chamber including a deodorizing fragrance block mounted therewithin to direct deodorizing air through the housing chamber, through the air conduit, and into the at least one drying frame.

* * * * *